US012808585B2

(12) United States Patent
Pistocchini et al.

(10) Patent No.: US 12,808,585 B2
(45) Date of Patent: Nov. 24, 2026

(54) ABSORPTION HEAT PUMP FOR IMPROVED PERFORMANCE IN HIGH DELIVERY WATER TEMPERATURE OPERATING CONDITIONS

(71) Applicant: ARISTON S.P.A., Fabriano (IT)

(72) Inventors: Lorenzo Pistocchini, Milan (IT); Marco Guerra, Bergamo (IT); Tommaso Toppi, Cantù (IT); Pietro Brevi, Bagnatica (IT); Luigi Tischer, Gorle (IT)

(73) Assignee: ARISTON S.P.A., Fabriano (IT)

( * ) Notice: Subject to any disclaimer, the term of this patent is extended or adjusted under 35 U.S.C. 154(b) by 90 days.

(21) Appl. No.: 18/727,849

(22) PCT Filed: Dec. 22, 2022

(86) PCT No.: PCT/IB2022/062667

§ 371 (c)(1),
(2) Date: Jul. 10, 2024

(87) PCT Pub. No.: WO2023/135478

PCT Pub. Date: Jul. 20, 2023

(65) Prior Publication Data

US 2025/0075951 A1 Mar. 6, 2025

(30) Foreign Application Priority Data

Jan. 11, 2022 (IT) ..... 102022000000284

(51) Int. Cl.
*F25B 30/04* (2006.01)
*F25B 15/04* (2006.01)
*F25B 41/20* (2021.01)

(52) U.S. Cl.
CPC ..... *F25B 30/04* (2013.01); *F25B 15/04* (2013.01); *F25B 41/20* (2021.01)

(58) Field of Classification Search
CPC ..... F25B 30/04; F25B 15/04; F25B 41/20; F25B 41/385; F25B 41/39; F25B 40/00; F25B 2339/047; Y02A 30/27; Y02B 30/62
(Continued)

(56) References Cited

U.S. PATENT DOCUMENTS 4,364,240 A * 12/1982 Schulz ..... F25B 30/04 62/476
4,718,243 A * 1/1988 Buschulte ..... F24H 4/00 62/476
(Continued)

FOREIGN PATENT DOCUMENTS

EP 2249105 A1 11/2010
EP 2249106 A1 11/2010
(Continued)

OTHER PUBLICATIONS

International Search Report and Written Opinion for PCT/IB2022/062667, dated Feb. 17, 2023.
(Continued)

*Primary Examiner* — Emmanuel E Duke
(74) *Attorney, Agent, or Firm* — Troutman Pepper Locke LLP

(57) ABSTRACT

An absorption heat pump apparatus for optimizing performance in low air temperature and/or high delivery water temperature operating conditions which maintains all the functions of the so-called booster systems, preventing the generator from exceeding the maximum temperature limits. Furthermore, the apparatus allows a significant increase in the efficiency of the heat pump when the booster mode is activated for producing high temperature hot water in the
(Continued)

case of medium or high outdoor temperatures, i.e., conventionally, for producing domestic hot water which is required throughout the year.

11 Claims, 12 Drawing Sheets

(58) Field of Classification Search
USPC ..... 62/476
See application file for complete search history.

(56) References Cited

U.S. PATENT DOCUMENTS

| | | | | |
|---|---|---|---|---|
| 2011/0225996 | A1* | 9/2011 | Guerra | F25B 30/04 62/476 |
| 2014/0298837 | A1* | 10/2014 | Tanda | F25B 41/24 62/150 |

FOREIGN PATENT DOCUMENTS

| | | | | |
|---|---|---|---|---|
| EP | 2372273 | A1 * | 10/2011 | F25B 15/04 |
| EP | 2249106 | B1 * | 4/2012 | F25B 15/04 |
| EP | 2372273 | B1 | 6/2012 | |

OTHER PUBLICATIONS

International Preliminary Report on Patentability for PCT/IB2022/062667, dated Dec. 6, 2023.

* cited by examiner

ABSORPTION HEAT PUMP FOR IMPROVED PERFORMANCE IN HIGH DELIVERY WATER TEMPERATURE OPERATING CONDITIONS

CROSS-REFERENCE TO RELATED APPLICATION

This application is a national stage application under 35 U.S.C. § 371 of PCT Application No. PCT/IB2022/062667, filed Dec. 22, 2022, which claims the priority benefit of Italian Patent Application No. 102022000000284, filed Jan. 11, 2022, each of which is incorporated by reference herein in its entirety.

FIELD OF THE INVENTION

The present invention relates to the technical field of gas-absorption heat pumps. In further detail, the present invention relates to the technical field of the so-called booster systems for absorption heat pumps, systems which allow to expand the operating range and increase the power which may be supplied under extreme operating conditions.

BACKGROUND ART

The gas absorption heat pump is based on a thermodynamic cycle in which the refrigerant fluid passes from the high pressure environment (condenser) to the low pressure environment (evaporator) through an expansion or throttling stage, to then return to the high pressure stage by means of a pump, rather than by means of a compressor as in conventional heat pumps.

In fact, absorption machines exploit the ability of a liquid substance (the absorbent) to chemically "absorb" a second chemical species in a gaseous state (the refrigerant); for example, an unsaturated solution of water and ammonia can absorb ammonia vapor.

I.e., the low-pressure refrigerant vapor is absorbed by the absorbent solution, which is pumped to a high pressure and sent to a generator.

In the generator, the solution is heated up to boiling, with the consequent production of high-pressure refrigerant vapor necessary to carry out the refrigeration cycle. Condenser and evaporator are heat exchangers, the refrigerant condenses at a high pressure in the condenser, transferring high temperature heat to the service fluid (conventionally water), and evaporates at a low pressure in the evaporator, removing low temperature heat from the service fluid (conventionally air, glycol water or salt solution).

The absorption occurs in an absorber and is promoted by the heat removal. The lower the temperature that may be reached, the lower the amount of solution required to absorb the refrigerant.

The separation of the liquid solution occurs in a generator by means of the introduction of heat. If the absorbent is volatile, as in ammonia-water machines, the vapors released do not exclusively consist of refrigerant fluid, and a rectifier is provided between the generator and the condenser to ensure a certain purity of the refrigerant fluid.

The transformations which the refrigerant and the absorbent solution undergo constitute the absorption refrigeration cycle. The energy which activates the cycle is provided in the generator, in particular in direct flame heat pumps by means of a burner, conventionally a gas burner, which, by means of a flame tube, heats the high-pressure solution rich in refrigerant.

In an attempt to reduce the environmental impact and the energy consumption of human activities, and in particular of heating and the production of domestic hot water (DHW)—which in Europe is the main responsible, together with the transport sector and the production of electricity, of CO2 emissions today—the European Commission has drawn up a ranking of the most efficient heating systems, whereby heat pumps, including absorption heat pumps, are in first place.

Gas absorption heat pumps are mainly applied in heating systems for residential and commercial buildings, where the demand for thermal power is conventionally a function of outdoor ambient temperatures. I.e., the thermal load of the building increases as the outdoor temperatures decrease. The power of heating appliances for a given building is chosen on the basis of a design temperature (defined by regulations for each given place) which is usually close to the average of the minimum temperatures recorded over a long period of years. In northern Italy, for example, this temperature is generally selected in the range between −10° C. and −5° C., in central Europe it is often selected around −20° C.

The hot water temperature in hydronic systems (common throughout Europe and the north-eastern USA) is also a function of the outdoor temperature, according to a selectable climatic curve, which allows to provide a better control of the power provided by the heating systems and therefore better comfort and lower consumption. Such climatic curve provides for higher hot water delivery temperatures in the system in the event of lower outdoor temperatures. For example, delivery water at 70° C. with outdoor temperatures of −20° C., with system power at 100% and delivery water at 40° C. with outdoor temperatures of +7° C., with system power at 35%. Low temperature operating conditions do not have a decisive weight on the energy efficiency profile of the system, since—at least in Europe—they account for a small fraction of the overall energy consumed for heating which is supplied with average ambient temperatures between 0° C. and 2° C.

However, said low temperature operating conditions have a fundamental importance in determining the maximum power and the system water temperatures which may be supplied. For this reason, the application of heat pumps for heating is not yet as widespread as it might be expected. In particular, the profiles of power output and temperatures obtainable from the heat pumps do not meet the existing requirements for heating buildings. Although heat pumps have an efficiency that may even double that of a boiler in ambient temperature conditions of 7° C. and a delivery water temperature of 40° C. with 100% of available power, they are hardly capable of reaching a delivery water temperature of 70° C. (currently only achievable with absorption heat pumps) and approach this temperature level with an available power equal to only 30% for electric heat pumps and 60% for absorption heat pumps.

Therefore, in low ambient temperature conditions, the heat pump has a low efficiency and, however, it must be capable of ensuring maximum power and maximum hot water delivery temperature. To do this while respecting the temperature limits of the generator, the heat pump must necessarily be oversized, or equipped with a back-up system.

In the case of oversizing, there is obviously a higher cost and also a system which is not optimized in usual operating conditions, with a performance greatly penalized in the case of working conditions with highly choked loads. In this case, in fact, it is possible to have heat pumps which work for a long time with loads which do not exceed 15-20% of the nominal load.

In the case of the use of a back-up, usually made by means of devices with limited energy efficiency, such as a boiler or a set of additional electrical resistors, a system is obtained still with a higher cost and above all characterized by a greater degree of complexity in terms of installation, operations management—which requires an additional electronic integration system between the various parts of the system—and maintenance.

In addition to the thermodynamic circuit, a direct flame absorption heat pump consists of a combustion system and an exchanger (generator), to which the combustion system provides the input power. Currently, in absorption heat pumps, said combustion system is of the modulating type and similar to that used on common boilers, and may be sized to cover a wide range of powers.

In case of need for a greater power and a higher delivery water temperature (such as, for example, in low outdoor temperature conditions described above), it is therefore possible to increase the input to the heat pump generator, but the increase in the temperature of the generator would soon lead to the intervention of overtemperature protection systems.

To contain this increase in the generator temperature, as the thermal input increases, so-called booster systems have been developed, which are introduced in patent documents IT1399062B1, EP2372273B1 and U.S. Pat. No. 8,950,212B2. These systems involve a particular circuit, which is activated by controlling a solenoid valve, and which allows the absorption heat pump to manage a high gas power without exceeding the maximum permissible temperatures for the generator, i.e., to contain the temperature within levels which do not involve the corrosion of the generator itself.

The aforesaid booster system allows the rich solution flow rate directed to the generator to bypass the recuperative exchangers in the absorption heat pump, and to take a portion of the liquid refrigerant flow rate downstream of the condenser by means of an injector. Thereby, the rich solution at the inlet to the generator is colder and richer in refrigerant. In the generator, said solution must therefore be heated starting from a lower temperature, and a greater amount of refrigerant must evaporate before the solution reaches the limit temperature: this allows for the significant increase in thermal input that the generator may handle. Furthermore, the withdrawal of liquid refrigerant downstream of the condenser reduces the load on the evaporator, which, in low air temperature conditions, is in any case not capable of evaporating the entire refrigerant flow rate when the machine works at full power.

In ammonia-water heat pumps, the so-called booster system also affects high pressure if it is configured so that the rich solution flow rate directed to the generator bypasses the rectifier. The inhibition of the rectification, in particular in conditions of high power and temperature in the generator, reduces the purity of the steam generated, i.e., it increases the concentration of absorbent (in this case water) thus reducing the condensation pressure given the same temperature of the hot water produced. This effect is positive, since it allows the delivery water temperature to be increased up to 80° C. without having to oversize the components in the high-pressure part of the heat pump. The negative effect of the reduced purity of the refrigerant is the increase in the evaporation temperature (given the same low pressure in the evaporator) which further reduces the performance of the evaporator and therefore of the heat pump in low air temperature conditions.

This so-called booster system therefore finds application in two operating conditions which are typical of the operation of a heat pump: with low air temperature, and consequent demand for high thermal power and high delivery water temperature, and in the production of domestic hot water, also in this case with the need to provide high thermal power and high delivery water temperature to reduce the size of the thermal storage. The fundamental difference between the two operating conditions is that the production of DHW is required throughout the year, even with high outdoor air temperatures, i.e., when the thermal input to the evaporator (which determines the efficiency of the heat pump) may be significant despite the lower degree of purity of the refrigerant due to reduced rectification. In the production of DHW, therefore, the withdrawal of a portion of the liquid refrigerant flow rate downstream of the condenser, generated by the so-called booster system and which favors the operation of the evaporator in low air temperature operating conditions, in most cases, leads to a significant reduction in the efficiency of the heat pump.

Therefore, the need for an improved system of the booster type, which may effectively solve the drawbacks described and other drawbacks present in the current state of the art, is clear.

BRIEF DESCRIPTION OF THE INVENTION

The present invention therefore relates to an absorption heat pump apparatus comprising a circuit for optimizing performance in low air temperature and/or high delivery water temperature operating conditions.

The apparatus according to the invention retains all the functions of the so-called booster systems, such as the containment of generator pressure as delivery water temperatures increase, and the increase of heat pump output under conditions where the evaporator is no longer capable of recovering heat from the low temperature source, as it occurs in the case of low outdoor temperatures, without exceeding the maximum temperature limits in the generator.

Furthermore, the apparatus according to the invention allows a significant increase in the efficiency of the heat pump when the booster mode is activated for producing high temperature hot water in the case of medium or high outdoor temperatures, i.e., conventionally, for producing domestic hot water which is required throughout the year.

The apparatus according to the present invention modifies the so-called booster system to improve the performance thereof, especially during the production of DHW by the heat pump. To achieve this result, in a preferred embodiment of the apparatus according to the present invention, an actuated control valve reducing the refrigerant withdrawal caused by the injector downstream of the condenser is used, and therefore an increase in the refrigerant flow rate to the evaporator, thus resulting in an increase of the relative thermal input and of the energy efficiency of the heat pump.

In a second preferred embodiment, a control valve is used on the circuit of lean solution directed from the generator to the absorber. Such valve controls the lean solution flow rate, and consequently the rich solution flow rate which the pump of the solution sends to the generator. The reduction of the rich solution flow rate chokes the effect of the injector, and therefore, also in this case, implies the reduction of the refrigerant withdrawal downstream of the condenser and the consequent increase of the refrigerant flow rate to the evaporator.

BRIEF DESCRIPTION OF THE DRAWINGS

Further features and advantages of the invention will become apparent from the reading of the following detailed description, given by way of non-limiting example, with the aid of the figures shown on the accompanying drawings, in which.

Figure 1:
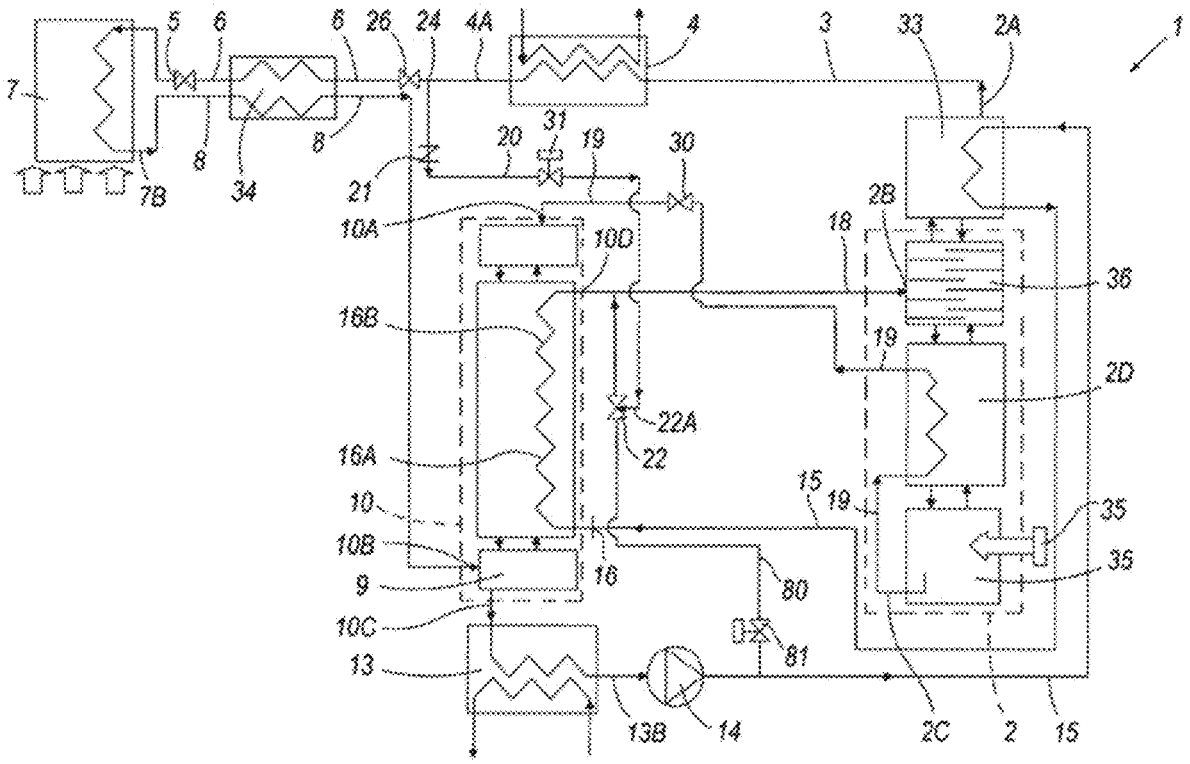
FIG. 1 shows a functional block diagram of a preferred embodiment of the apparatus according to the present invention comprising an actuated control valve located on the liquid refrigerant line and a throttling valve on the lean solution line.

The following description of exemplary embodiments relates to the accompanying drawings. The same reference numbers in the various drawings identify the same elements or similar elements. The following detailed description does not limit the invention. The scope of the invention is defined by the appended claims.

DETAILED DESCRIPTION OF THE INVENTION

The heat pump shown in the accompanying FIGS. 1-12 works with a cycle which uses a first fluid (in the specific case, ammonia) as refrigerant, which is absorbed into a second fluid (in this case, a solution of water and ammonia). The solution of the two fluids varies in composition during the thermodynamic cycle it goes through; it is therefore called lean when it contains a low quantity of said first fluid and rich when, instead, it contains a high quantity thereof.

The direct flame absorption heat pump comprises a conventional generator 2, or desorber, which receives heat from a burner, generally a gas burner, 35*b* on a preferably finned boiler 35, which feeds a distillation column 36. The distillation column 36, in turn, is connected to a rectifier 33 so that the outlet of the steam of the generator 2 is connected, by means of said rectifier 33 and a first steam line 3, to a condenser 4, located in heat exchange contact with a heat-transfer fluid which feeds the heating system. This fluid is usually water provided to the system by means of a pump, not shown.

Downstream of the condenser 4 there is a counter-current heat exchanger, 34, connected to said condenser 4 by a second line 6 on which there is a throttling valve 26, adapted to exchange heat with the steam circulating in a third line 8 which connects the outlet 7B of the evaporator 7—in turn connected downstream of the heat exchanger 34 by means of the line 6 and the throttling valve 5—to an inlet 10B of an absorber 10. Said evaporator 7 may have as a heat source outdoor air, or water from a low enthalpy geothermal source, groundwater, etc.

The vapor of said first fluid is thus blown into the mixer 9 of the absorber 10, and a rich two-phase solution (comprising ammonia vapor and ammonia absorbed in liquid water) therefore emerges from the outlet 10C of said mixer, which is sent as input to a second absorber 13 in heat exchange contact with the heat-transfer fluid of the heating system.

An outlet 13B of the heat exchanger 13 is connected to the suction side of a pump 14, the delivery side of which is connected, by means of a fourth line 15, to an inlet 16 of a circuit 16A, 16B in heat exchange contact with the absorber 10. Said fourth line 15 is in heat transfer contact with the rectifier 33 from which the ammonia-rich solution removes heat to facilitate the condensation of the water vapor.

Said circuit 16A, 16B is adapted to remove heat from the absorber 10 to then transfer it to the rich solution coming from the pump 14 before being introduced into the generator 2. In the first part of said circuit 16A the rich solution rises in temperature, and in the second part 16B the ammonia present in the solution begins to evaporate (under the pressure present in the circuit 16A, 16B) substantially anticipating the work then performed by the generator 2. The ammonia-rich solution and the ammonia vapor which has begun to form is then directed, by means of a fifth line 18, from the heat exchanger 10 to the inlet 2B of the generator 2.

At the base of the generator 2, close to the boiler 35, an outlet 2C is provided from which an ammonia-lean solution is conveyed, by means of a sixth line 19, to an inlet 10A of the absorber 10, after having released heat to the fluids present in the generator in a central 2D portion thereof. The line 19 is provided with at least one throttling valve 30.

The first line 3 is connected, downstream of the condenser 4, to a sampling line 20, which extends from a sampling point 24 and leads to the bypass line 80 at an introduction point 22A of an injector (venturi) 22. The bypass line 80 further comprises a solenoid valve 81 adapted to control the exclusion or activation of said bypass line 80 from the circuit.

The bypass line 80, by means of the dragging effect of the injector 22, acts so as to withdraw part of the liquid refrigerant output from the condenser 4, and mix it in the rich solution line in input to the generator 2. Furthermore, it prevents the rich solution from being heated in the rectifier 33 and in the absorber 10.

In further detail, the opening of the solenoid valve 81 introduces into the circuit a simultaneous bypass for the rich solution pumped towards the generator 2 and for a part of the liquid refrigerant output from the condenser 4, to re-introduce them directly into the generator 2, above the portion of exchanger 2D.

In essence, the bypass line 80 obtains two effects: on the one hand, with the sampling line 20, the rich solution is further enriched, thus increasing the thermal input which may be provided to the generator 2; on the other hand, the rich solution is sent to the generator without it being heated by the rectifier 33 and by the absorber 10, thus contributing, also in this case, to increasing the thermal input which may be provided.

Thereby, the thermal input of the generator 2 (usually, the combustion products of a boiler 35 with power modulation) is increased up to a maximum of +80% of the maximum power at nominal conditions. When the solenoid valve 81 is closed, the refrigerant bypass is inactive since the injector (or venturi) 22A is not crossed by the fluid and the flow in the reverse direction is prevented by the non-return valve 21. The range of conditions within which the bypass may be inserted into the circuit may be advantageously programmed in the system controller.

In a preferred embodiment of the invention, shown in the accompanying FIG. 1, an actuated valve 31, comprising a control valve, is located on the liquid refrigerant line 20 upstream of the introduction point 22A of the injector 22. Such valve allows reducing the withdrawal of liquid refrigerant by the rich solution, and therefore increasing the refrigerant flow rate to the evaporator 7 where, in case of a sufficient temperature of the heat source (for example, the air temperature in summer or in mid-seasons), the thermal input and the overall efficiency of the heat pump are increased.

Figure 2:
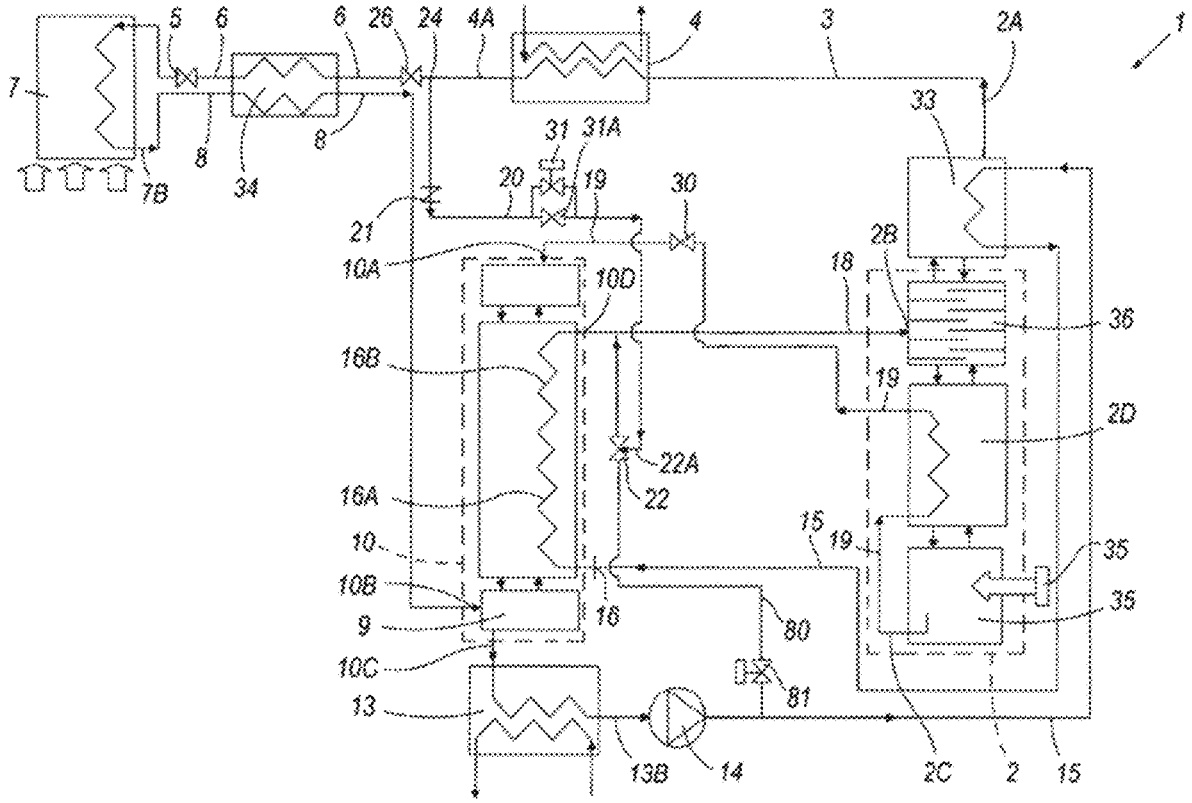
FIG. 2 shows a functional block diagram of another preferred embodiment of the apparatus according to the present invention comprising an actuated valve, in parallel with a further flow rate control member, located on the liquid refrigerant line and a throttling valve on the lean solution line.

In an alternative embodiment of the invention, shown in the accompanying FIG. 2, the actuated valve 31 may be both a control valve as well as a shut-off valve, and is located in parallel with a further flow rate control member 31A, which, in case of a complete closure of the valve 31, determines the minimum flow rate of refrigerant ensured to the injector 22.

In alternative embodiments of the invention, the control of the refrigerant flow rate withdrawn from the rich solution in the injector 22 is advantageously obtained by directly controlling the lean solution flow rate, which, in turn, determines the rich solution flow rate. In fact, the pump 14 only acts on the flow rate received from the absorber 13, which consists of the lean solution flow rate and the refrigerant flow rate coming from the evaporator 7. The passage of a lower rich solution flow rate inside the injector (venturi) 22 results in the lesser withdrawal of refrigerant downstream of the condenser 4 by means of said sampling line 20.

Figure 3:
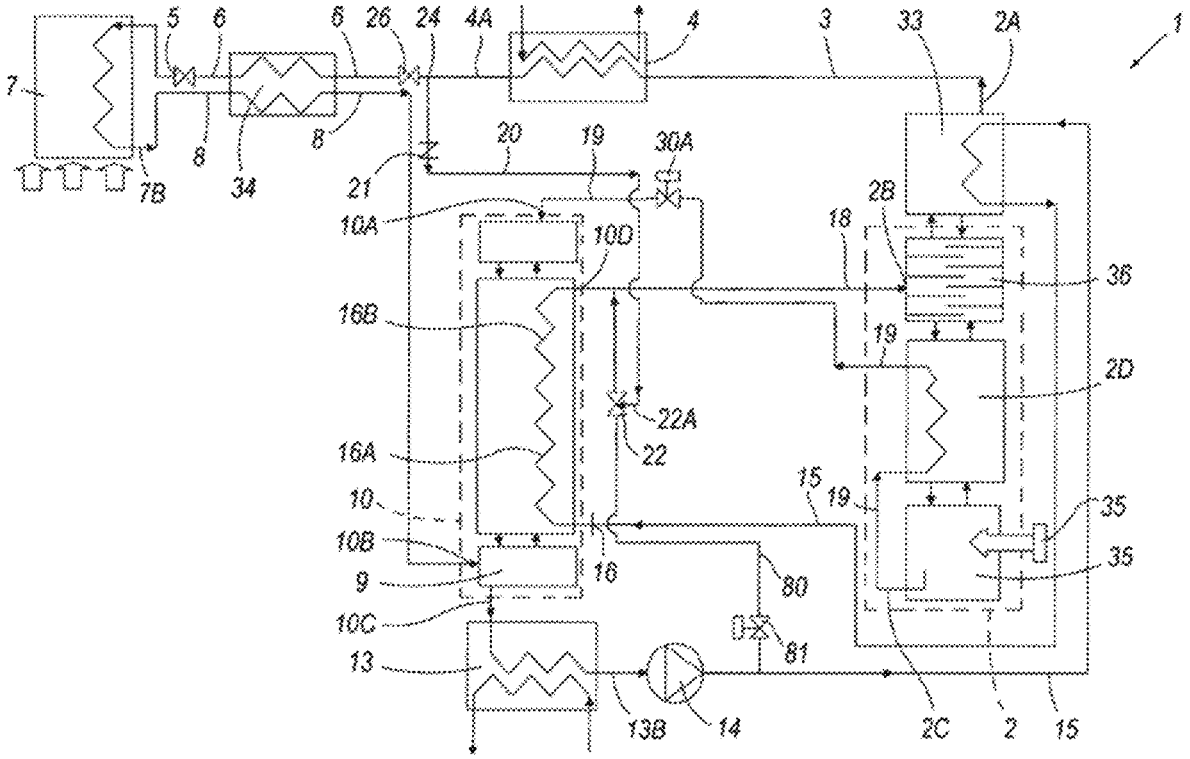
FIG. 3 shows a functional block diagram of another preferred embodiment of the apparatus according to the present invention comprising a variable expansion valve on the lean solution line.
Figure 4:
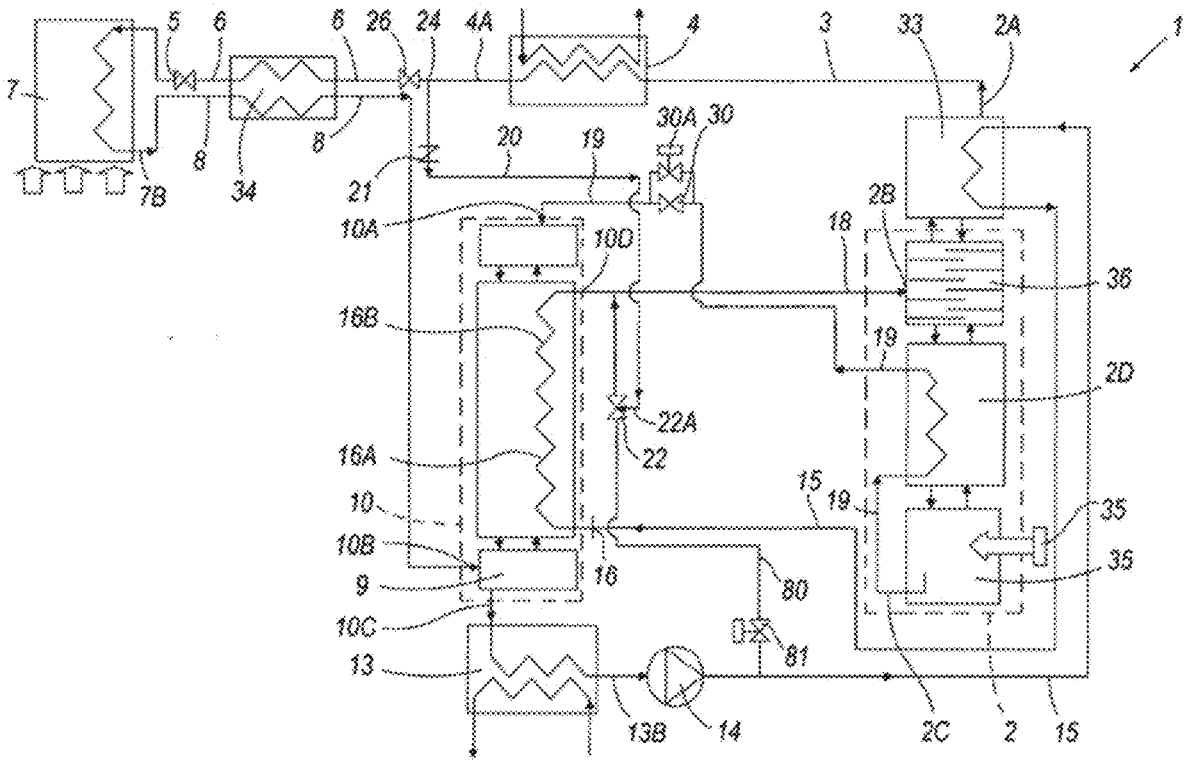
FIG. 4 shows a functional block diagram of another preferred embodiment of the apparatus according to the present invention comprising a variable expansion valve in parallel with a throttling valve on the lean solution line.
Figure 5:
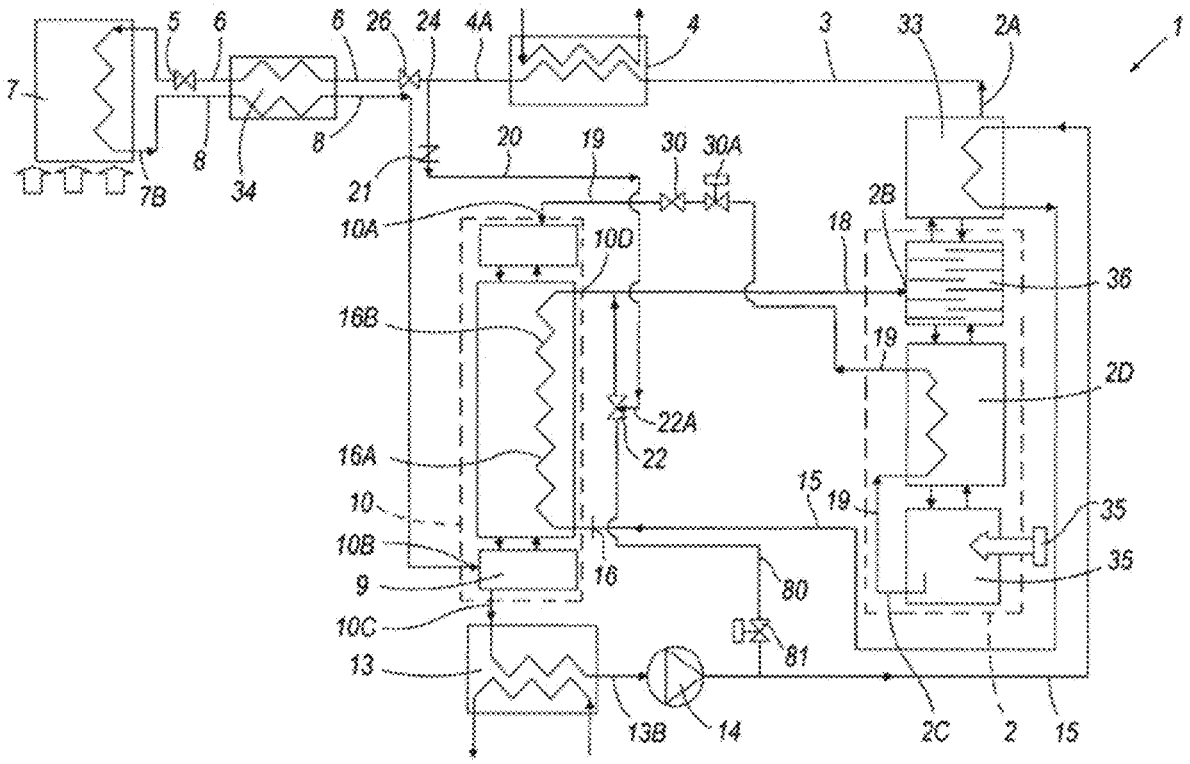
FIG. 5 shows a functional block diagram of another preferred embodiment of the apparatus according to the present invention comprising a variable expansion valve in series with a throttling valve on the lean solution line.

The control of the lean solution flow rate may be achieved in a continuous manner by replacing the throttling valve 30 on the lean solution line 19 with a single variable expansion valve 30A, as shown in the accompanying FIG. 3, or by adding the aforesaid variable expansion valve 30A in parallel, as shown in FIG. 4, or in series, as shown in FIG. 5, to the throttling valve 30.

Figure 6:
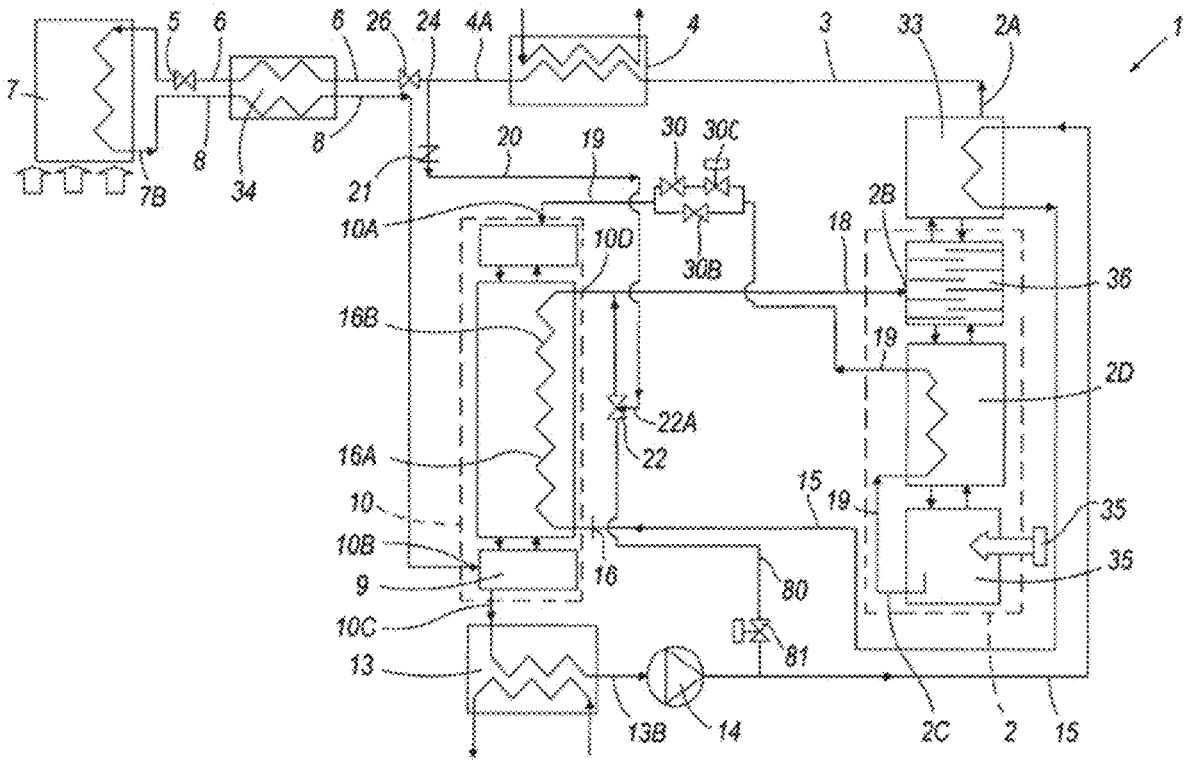
FIG. 6 shows a functional block diagram of another preferred embodiment of the apparatus according to the present invention comprising, on the lean solution line, two or more throttling valves of different sizes, which may be selected independently by means of actuated shut-off valves.
Figure 7:
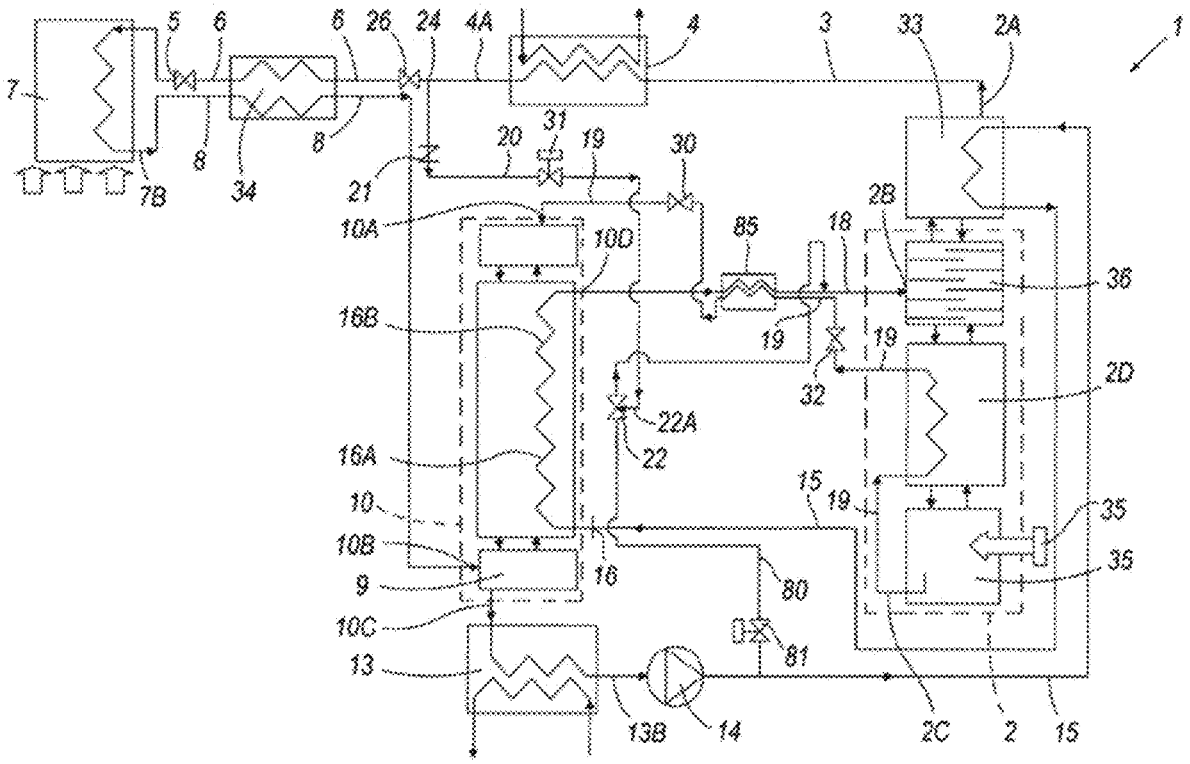
FIG. 7 shows a functional block diagram of a preferred embodiment of the apparatus according to the present invention comprising an actuated control valve located on the liquid refrigerant line and a throttling valve on the lean solution line and comprising a further heat exchanger associated with the lean solution line.
Figure 8:
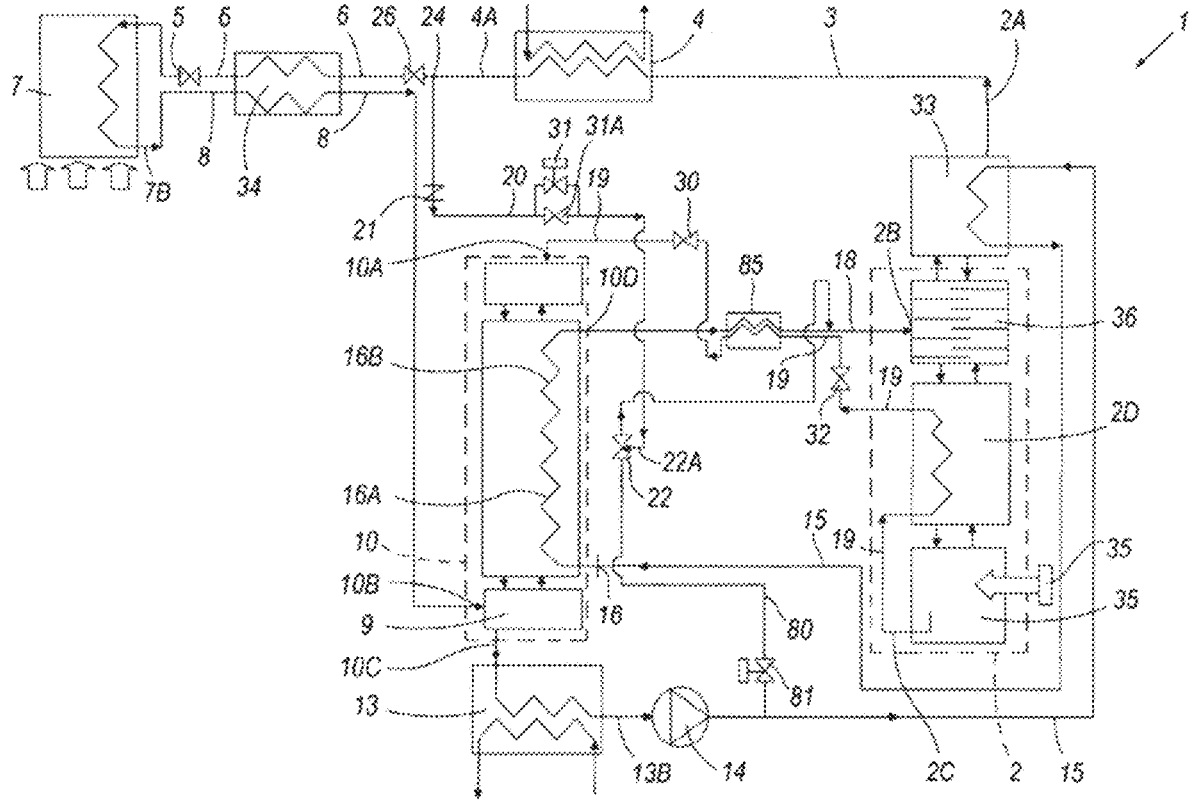
FIG. 8 shows a functional block diagram of another preferred embodiment of the apparatus according to the present invention comprising an actuated valve, in parallel with a further flow rate control member, located on the liquid refrigerant line and a throttling valve on the lean solution line, and comprising a further heat exchanger associated with the lean solution line.
Figure 9:
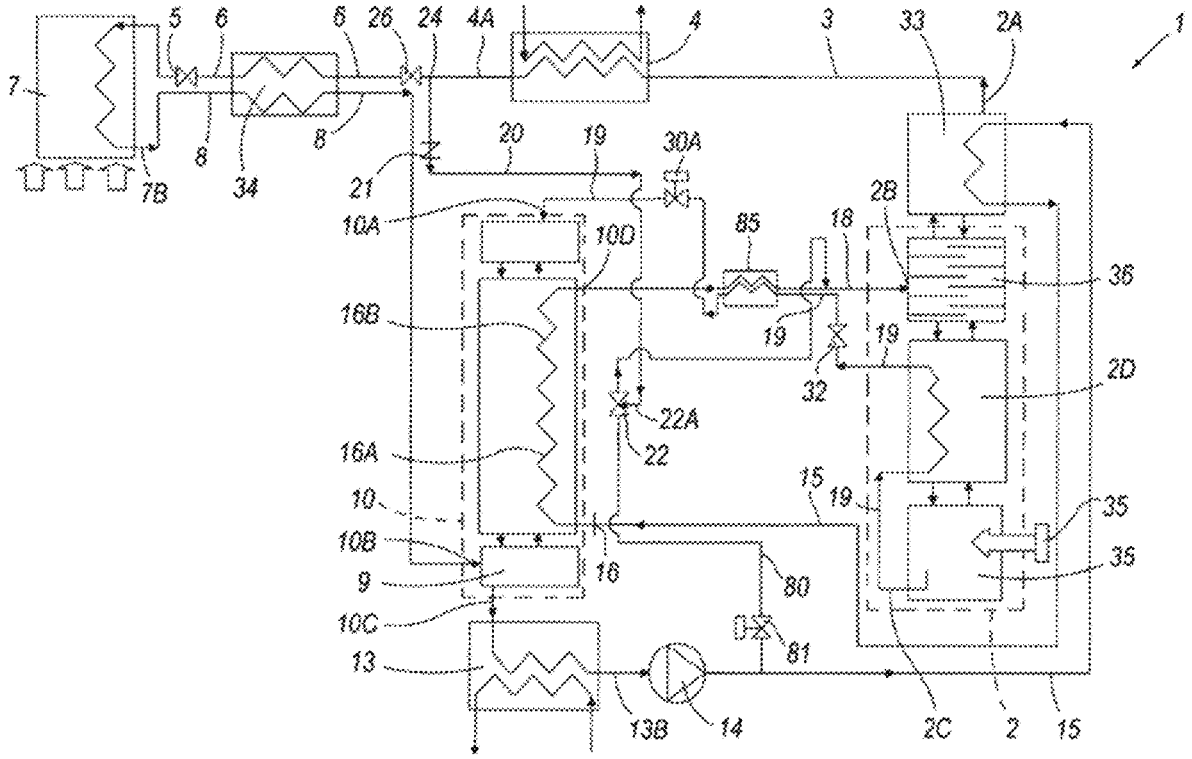
FIG. 9 shows a functional block diagram of another preferred embodiment of the apparatus according to the present invention comprising a variable expansion valve on the lean solution line, and comprising a further heat exchanger associated with the lean solution line.
Figure 10:
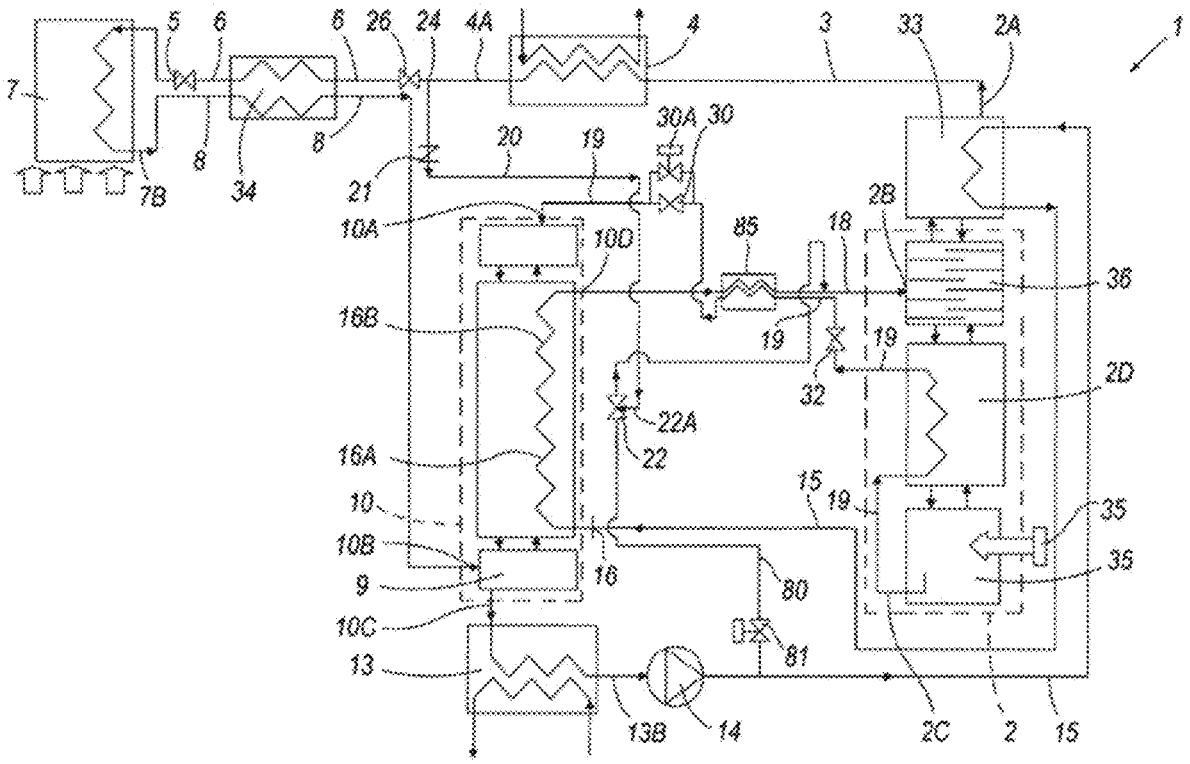
FIG. 10 shows a functional block diagram of another preferred embodiment of the apparatus according to the present invention comprising a variable expansion valve in parallel with a throttling valve on the lean solution line, and comprising a further heat exchanger associated with the lean solution line.
Figure 11:
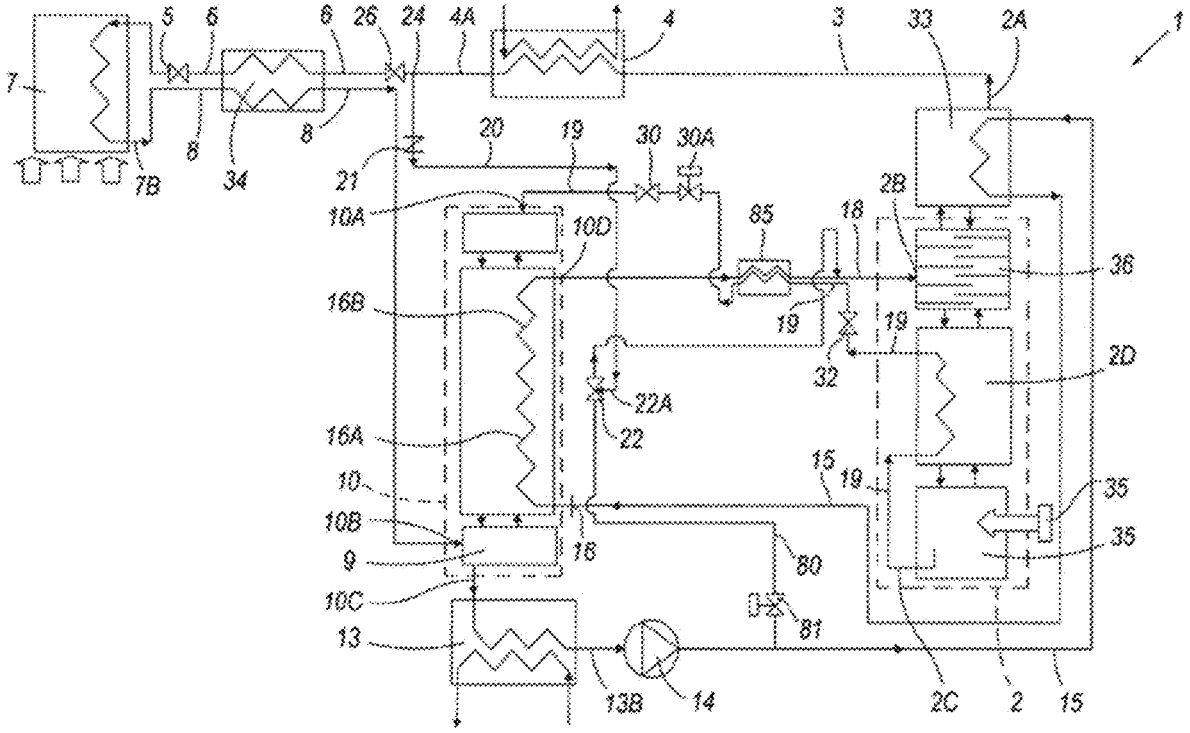
FIG. 11 shows a functional block diagram of another preferred embodiment of the apparatus according to the present invention comprising a variable expansion valve in series with a throttling valve on the lean solution line, and comprising a further heat exchanger associated with the lean solution line.
Figure 12:
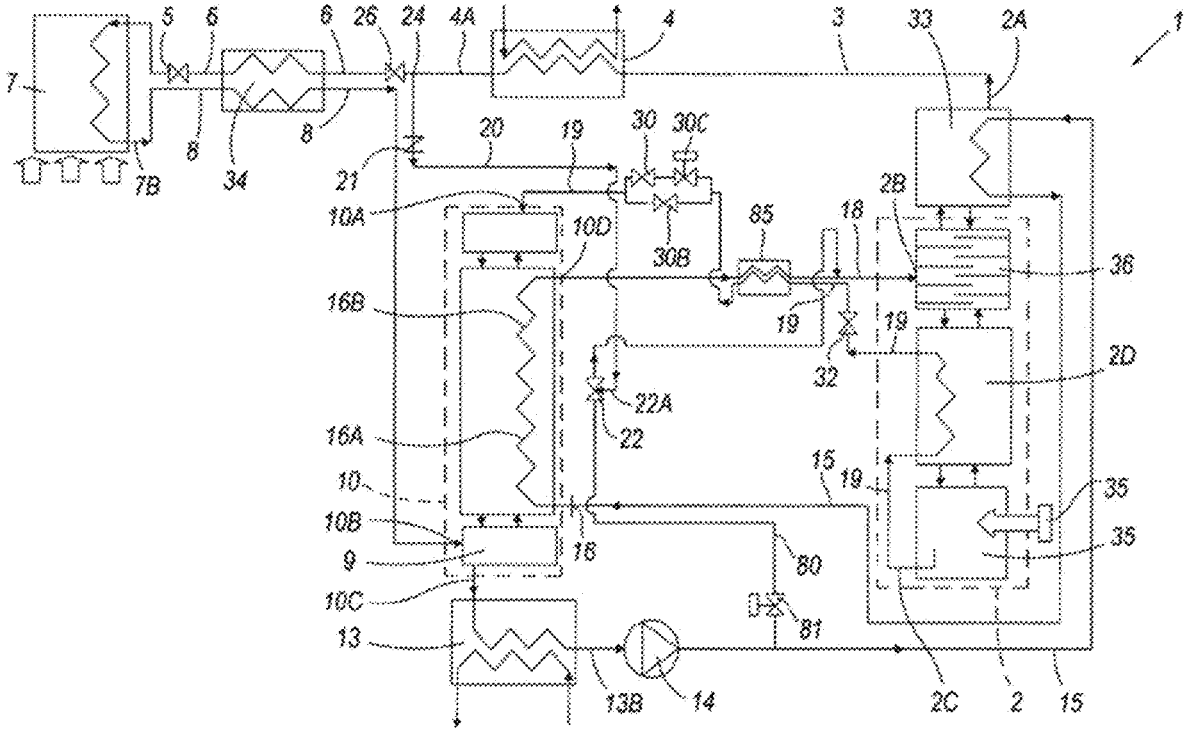
FIG. 12 shows a functional block diagram of another preferred embodiment of the apparatus according to the present invention comprising, on the lean solution line, two or more throttling valves of different sizes, which may be selected independently by means of actuated shut-off valves, and comprising a further heat exchanger associated with the lean solution line.

In a further alternative embodiment of the invention, shown in the accompanying FIG. 6, two or more throttling valves of different sizes (30, 30B) are used, which may be selected independently by means of actuated shut-off valves (30C) to discreetly vary the lean solution flow rate. A further version of the system described, shown in the accompanying FIGS. 7-12, may also comprise a further heat exchange between said fifth line 18 and said sixth line 19. This heat exchange is obtained by means of a heat exchanger 85 preferably of the counter-current type. Advantageously, upstream of the heat exchanger 85, in the sixth line 19 of the lean solution, a first throttling valve 32 is provided; in the sixth line 19, downstream of the heat exchanger 85, and on the withdrawal line 20, any of the combinations previously described, and represented in the accompanying FIGS. 1-6, of the aforesaid valves 30, 30A, 30B, 30C, 31, 31A, are provided.

Therefore, if the system is in high outdoor air temperature conditions, such that the evaporator may be very efficient (for example, in mid-seasons or in summer) and there is a need to produce very hot water, which requires activating the bypass circuit 80 (for example, for producing DHW), then, by selecting or controlling a suitable member for controlling the flow rate on the liquid refrigerant line 20 or on the lean solution line 19, the refrigerant flow rate to the evaporator 7 is increased, since the withdrawal thereof from the injector 22 is reduced, and the overall efficiency of the heat pump is increased.

The invention claimed is:

1. An absorption heat pump comprising:

a generator adapted to produce steam starting from a first fluid and comprising a first outlet for supplying said steam, by means of a first line, to a condenser in heat exchange contact with a heat-transfer fluid;

an evaporator fed by a second line arranged downstream of the condenser and comprising at least one first expansion valve;

an absorber provided with a feeding inlet, connected to a third line which leads said steam exiting the evaporator, and with an outlet for an enriched solution of said first fluid absorbed in a second fluid;

a heat exchanger, in heat transfer contact with said heat-transfer fluid, provided with an inlet connected to the outlet of the absorber;

a pump having a suction side connected to an outlet of the heat exchanger;

a circuit, in heat transfer contact with the absorber and having an inlet, connected by means of a fourth line to a delivery side of the pump, and an outlet connected to a rich solution inlet of the generator by means of a fifth line;

a bypass line of the absorber connected to said fourth line and provided with a valve adapted to allow said absorber to be at least partially excluded from the circuit;

a sampling line adapted to introduce the refrigerant liquid into the rich solution at an introduction point downstream of the pump;

wherein said generator comprises a second lean solution outlet connected by a sixth lean solution line to a lean solution inlet of the absorber, said sixth lean solution line comprising first valve means configured to control the flow rate of the lean solution so as to indirectly influence the amount of refrigerant withdrawn downstream of the condenser by an injector, wherein said control is such as to reduce the amount of refrigerant withdrawn downstream of the condenser and increase the refrigerant flow rate to the evaporator.

2. The absorption heat pump according to claim 1 further comprising second control valve means, arranged on said line leading to said injector and adapted to reduce the withdrawal of refrigerant caused by the injector downstream of the condenser, wherein said second control valve means is configured to directly control the amount of refrigerant withdrawn downstream of the condenser.

3. The absorption heat pump according to claim 2 wherein said second valve means comprise an actuated valve.

4. The absorption heat pump according to claim 3 wherein said second valve means comprise a further flow rate control member.

5. The absorption heat pump according to claim 1 wherein said first valve means comprise at least one variable expansion valve in parallel with a throttling valve.

6. The absorption heat pump according to claim 1 wherein said first valve means comprise at least one variable expansion valve in series with a throttling valve.

7. The absorption heat pump according to claim 1 wherein said first valve means comprise a first throttling valve in parallel to a variable expansion valve connected in series to a second throttling valve.

8. The absorption heat pump according to claim 1 wherein said first valve means comprise two or more throttling valves of different sizes, which may be selected independently by means of actuated shut-off valves to discreetly vary the lean solution flow rate.

9. The absorption heat pump according to claim 1 further comprising a heat exchanger between said fifth line and said sixth lean solution line.

10. The absorption heat pump according to claim 1, further comprising a throttling valve placed in said sixth lean solution line, upstream of the heat exchanger.

11. The absorption heat pump according to claim 1 wherein said first fluid is ammonia and said second fluid is a solution of water and ammonia.

* * * * *